US005577445A

United States Patent [19]

Haller

[11] Patent Number: 5,577,445

[45] Date of Patent: Nov. 26, 1996

[54] CONTROL SYSTEM FOR WEB-FED ROTARY PRINTING MACHINES

[75] Inventor: Ralf Haller, Offersheim, Germany

[73] Assignee: Heidelberger Druckmaschinen AG, Heidelberg, Germany

[21] Appl. No.: 27,697

[22] Filed: Mar. 8, 1993

[30] Foreign Application Priority Data

Mar. 6, 1992 [DE] Germany ..... 42 07 071.6

[51] Int. Cl.[6] ..... B41F 23/04

[52] U.S. Cl. ..... 101/424.1; 101/488

[58] Field of Search ..... 101/487, 424.1, 101/484, 181, 228, 488; 432/72, 37, 59; 34/33, 25, 41, 52

[56] References Cited

U.S. PATENT DOCUMENTS 4,150,495 4/1979 Stern .
4,504,220 3/1985 Sunakawa et al. ..... 432/72
4,888,885 12/1989 Caughey ..... 34/33
5,060,572 10/1991 Waizmann .
5,097,764 3/1992 Waizmann .

FOREIGN PATENT DOCUMENTS 0065783 12/1982 European Pat. Off. .
346041 12/1989 European Pat. Off. .
2458935 6/1975 Germany .
3740294 6/1988 Germany .
3723400 2/1989 Germany .
3939190 8/1990 Germany .

*Primary Examiner*—J. Reed Fisher
*Attorney, Agent, or Firm*—Herbert L. Lerner; Laurence A. Greenberg

[57] ABSTRACT

Method of controlling a rotary printing machine having a thermal dryer to which a combustion system is post-connected, includes determining changes in temperature of exhaust gas in the combustion system and, in accordance therewith, varying the speed of operation of the rotary printing machine; and device for performing the method.

12 Claims, 4 Drawing Sheets

CONTROL SYSTEM FOR WEB-FED ROTARY PRINTING MACHINES

SPECIFICATION

The invention relates to a control system for rotary printing machines, more particularly, web-fed rotary printing machines with devices for after-treatment of dryer exhaust air.

The published German patent document 37 40 294 A1 shows a device for controlling the temperature of a web of printing material in a web dryer during the start-up phase of a printing machine. In this construction, velocity of the web is influenced by a constant-value control as a function of the difference in temperature determined between the reference value and actual value. This permits an acceleration or run-up of a web-fed rotary printing machine adapted to the heat-up phase of the web dryer.

The approach outlined in the aforementioned German patent document, however, cannot prevent washing fluid from entering the web dryer in sudden bursts in the operating mode "blanket washing" nor the solvent concentration from reaching the lower explosion limit as a consequence thereof.

The published European patent document (EP) 0 346 041 A2 shows a control system for a dryer having a built-in after-burner and a recuperative exhaust gas guidance. The solvent gases are directed into the after-burner in order to use the inner energy remaining contained in the gases to save primary energy. The solvent remaining in the gases is oxidized downstream thereof by the flame or cleaned by using a catalytic agent. In this heretofore known control system, the solvent concentration is kept sufficiently away from the lower explosion limit by means of a controllable exhaust fan.

It is an object of the invention of the instant application to provide an improvement in the state of the art by excluding any possibility of exceeding threshold values in thermal drying processes.

With the foregoing and other objects in view, there is provided, in accordance with the invention, a method of controlling a rotary printing machine having a thermal dryer to which a combustion system is after-connected, which comprises determining changes in temperature of exhaust gas in the combustion system and, in accordance therewith, varying the speed of operation of the rotary printing machine.

An advantage attainable by this inventive method is that flame ionization detectors which are expensive and not very suitable for continuous operation are no longer needed. Furthermore, temperature-change behavior per unit of time may be detected reliably and accurately, so that significant measuring values may be calculated or computed therefrom. By selecting the temperature-change behavior as a control parameter, the assurance against exceeding the lower explosion limit is withdrawn and is not subjected to the influence of the operator so that damage to structures and persons is effectively prevented.

In accordance with another measure, the method according to the invention includes continuously measuring the temperature of the exhaust gas, continuously detecting or registering the measured temperature values, and calculating therefrom an amount of solvent transformed in the combustion system from a vapor thereof formed in the thermal dryer from a solvent-bearing web passing therethrough.

The detection or registration of the temperature gradient affords rapidly responsive closed-loop control, because sharp increases in temperature are immediately noted.

In accordance with a further measure, the method according to the invention includes comparing the calculated amount of transformed solvent with a maximally permissible solvent amount both in a "production run" and in a "washing" mode of operation of the rotary printing machine. Furthermore, the rotary printing machine is controlled when being in the production mode as well as in the wash-up mode on the basis of a comparison between the determined transformed solvent amounts and the permissible maximum solvent amount.

The advantage of the foregoing method is that a sufficient safety margin with respect to the lower explosion limit is maintained and ensured not only in the start-up mode but also during the production run and in the operating mode "blanket washing".

In accordance with another aspect of the invention, there is provided a device for controlling a rotary printing machine having a thermal dryer and a combustion system after-connected to the thermal dryer, comprising means for determining changes in temperature of exhaust gas in the combustion system, and means for varying speed of operation of the rotary printing machine in accordance with temperature changes determined by the determining means.

In accordance with a further feature of the invention, the device includes means for continuously detecting measured temperature values of the exhaust gas in the combustion system, and means for calculating therefrom an amount of solvent transformed in the combustion system from a vapor thereof formed in the thermal dryer from a solvent-bearing web passing therethrough.

In accordance with an additional feature of the invention, the device includes means for comparing the calculated amount of transformed solvent with a maximally permissible solvent amount.

In accordance with an added feature of the invention, the rotary printing machine has a main drive, and there are included a control unit comprising the calculating means connected between and to the main drive and the combustion system, and means for continuously transmitting from the continuously detecting means continuously detected measured temperature values to the control unit.

In accordance with yet another feature of the invention, the device includes a control line connecting locations at which the temperature values are measured in the combustion system to the control unit.

In accordance with yet a further feature of the invention, the control unit includes electronic evaluation means. On-line operation of the control unit is thereby ensured.

In accordance with yet an added feature of the invention, the device includes an operating panel, and an operating line connecting the operating panel to the control unit for adjusting the control unit. With such a construction, for example, the assurance or reliability against reaching the lower explosion limit for printing-material webs which are extremely thin yet are laden with much ink and solvent can be increased. Consequently, the control unit can be adapted also to stricter government regulations without requiring complicated and costly change-over efforts.

In accordance with yet an additional feature of the invention, the device includes means for comparing the calculated amount of transformed solvent with a maximally permissible solvent amount, and the control unit having means for varying the speed of the main drive in accordance with a comparison result of the comparing means.

In accordance with a concomitant feature of the invention, the device includes means for shutting the combustion system down, and means for by-passing the combustion system and discharging the solvent vapors into the surroundings, the control unit being actuatable for influencing the operating speed of the rotary printing machine in accordance with the maximum permissible temperature of the combustion system and for thereby preventing activation of the shutdown means and the by-pass means.

Accordingly, signals or pulses from the combustion system are forwarded to the control unit, and the control unit varies the speed of the main drive as a function of the difference resulting from a comparison between the permissible maximum solvent amount and the amount of solvent actually contained in the exhaust.

In this manner, it is possible to restore and keep below the required preset safety margin so as not to reach the lower explosion limit by decreasing the amount of solvent entering the dryer as a result of reducing the machine speed. In an extreme case, the control unit may activate the "impression off" mode or bring the printing machine to a complete standstill, when the permissible maximum amount of solvent is exceeded.

Other features which are considered as characteristic for the invention are set forth in the appended claims.

Although the invention is illustrated and described herein as embodied in a control for web-fed rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
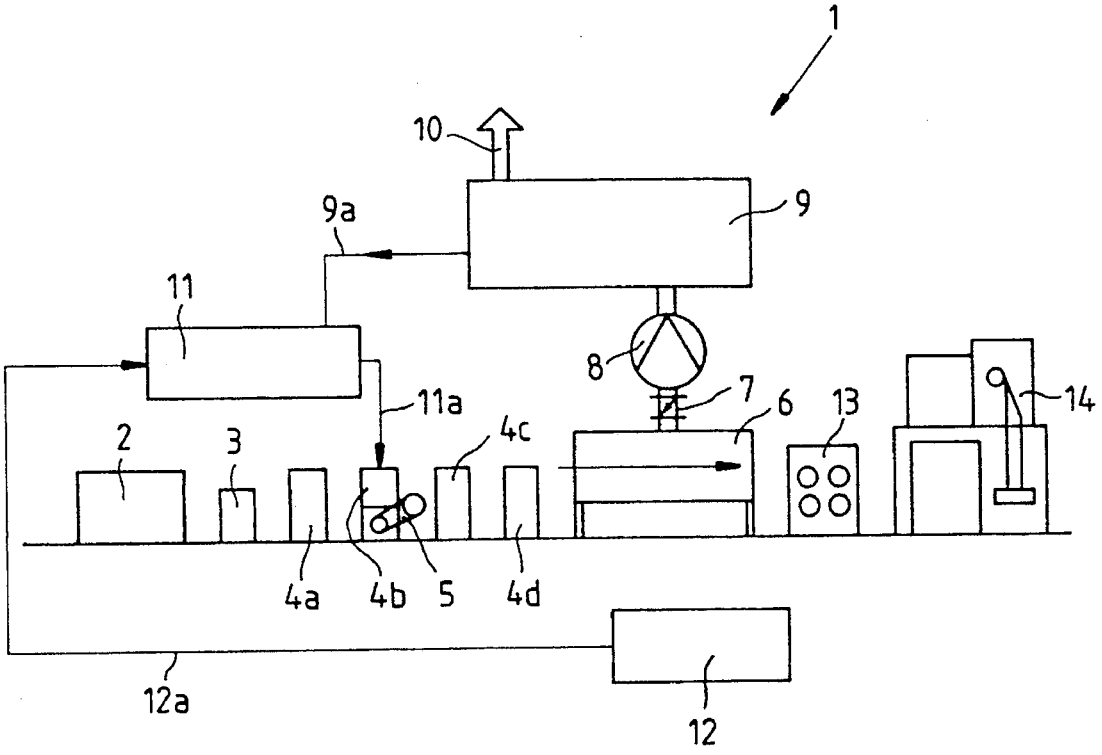
FIG. 1 is a diagrammatic and schematic view of a configuration of the control system as applied to a web-fed rotary printing machine, in accordance with the invention.

Referring now to the figures of the drawing in detail and first, particularly, to FIG. 1 thereof, there is shown therein a rotary printing machine 1 formed of many components arranged behind or above one another. A web splicer 2 is followed by an infeed unit 3 which, in turn, is followed by several printing units 4*a*, 4*b*, 4*c* and 4*d*, for example. In the illustrated embodiment, a main drive 5 is assigned to the printing unit 4*b*. A thermal dryer 6 is provided downstream from the last printing unit 4*d* in the direction of web travel represented by the arrow superimposed on the dryer 6 in FIG. 1. The thermal dryer 6 is followed by a chill roll assembly 13 which, in turn, is followed by a superstructure including a folding unit 14. Above the dryer 6, a fan or blower 8 is provided which is connected to the thermal dryer 6 via a throttle or butterfly valve 7 disposed upstream of the fan 8. The fan 8 is followed by a combustion system 9 having an exhaust outlet 10.

Non-illustrated temperature sensors or detectors, which are connected to a control unit 11 via a control line 9*a*, are disposed inside the combustion system 9, in the vicinity of the exhaust outlet 10. Via the control line 9*a*, measured temperature values are continuously fed to the control unit 11 which is directly connected to the main drive 5 via a control line 11*a*. Within the control unit 11, is an evaluation electronic system formed of an input component, a processing component and an output component. Input values may be communicated to the control unit 11 via an operating line 12*a* from an operating panel 12. Thus, for example, information may be inputted that the solvent concentration in the dryer exhaust gas should not exceed 25% of the lower explosion limit. Depending upon requirements, this officially prescribed value may be individually adjusted if stricter safety regulations are applicable.

Solvent vapors emanating from the printed printing-material web in the dryer 6 during the drying process mix with air to form a gas mixture, i.e., dryer exhaust gas, which is combustible under certain circumstances. By means of the fan or fans 8 disposed downstream from the dryer 6, the volume flow of the exhaust gas, which is controllable by the throttle or butterfly valve 7, is conveyed to the combustion system 9. In the combustion system 9, the hydrocarbon compounds of the dryer exhaust gas mixture are very extensively oxidized, and the burnt gas is discharged via the exhaust outlet 10. Due to the transformed internal energy of the dryer exhaust gas in the combustion system 9, the primary energy to be supplied to the combustion system 9 may be reduced, as long as a steady state exists.

The temperature sensors or detectors inside the combustion system 9 continuously communicate measured temperature values to the evaluation electronic system of the control unit 11. From these measured values, a temperature gradient is determined from which a solvent-concentration gradient is derivable. The charging or loading of the dryer exhaust gas with expelled solvent vapors is apparent from these gradients. The solvent-concentration gradient is compared with a stored preset solvent-concentration value so as to ensure adequate reliability or security against reaching the lower explosion limit. If an increase in the temperature of the exhaust gas leaving the combustion system 9 is detected, this signifies an increase of the solvent concentration inside the dryer 6 in the "production run" mode. The control unit 11 then acts upon the main drive 5 via the control line 11*a*, and reduces the speed of the rotary printing machine 1. The web velocity decreases, and the solvent entering the dryer 6 is reduced correspondingly. In an extreme case, the printing machine can be switched into the "impression off" mode or brought to a complete standstill via the control unit 11. In such a case, the machine speed is reduced automatically and is, accordingly, removed from subjective evaluation by the pressman or other servicing or operating personnel, thereby ensuring greater reliability of the printing machine or its operating system. If the temperature of the exhaust gas decreases again, the then machine speed may be increased by the control unit 11 to the machine speed existing prior to the application of the control unit 11, or the pressman or other servicing or operating personnel may be given a signal indicating that the region of dangerous concentration (>25% lower explosion limit) has been passed through.

By presetting the control unit 11 provided at the operating panel 12, a hard or soft characteristic of the response behavior, i.e., less sensitive or more sensitive, respectively, of the control unit 11 towards changes in temperature within the combustion system 9 may be established. The system may, thereby, be adapted to individual requirements of the production process. For relatively thin, heavily printed material, for example, the response characteristic of the control unit 11 is set so that, even when there is a slight increase in temperature in the exhaust gas, a reduction of the machine speed occurs in the "production run" mode. For thicker material having an average amount of printing thereon, higher temperature fluctuations in the exhaust gas are permissible without causing the control unit 11 to activate the main drive 5 for the purpose of decelerating or slowing-down the printing machine.

Figure 2:
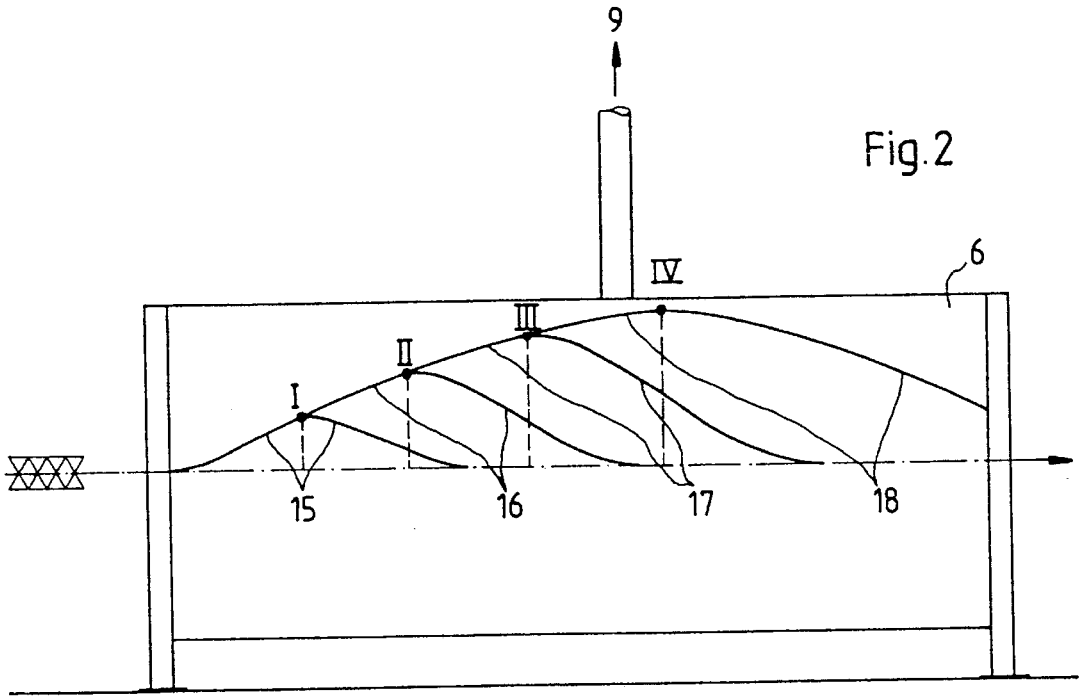
FIG. 2 is an enlarged fragmentary view of FIG. 1 showing a dryer and, superimposed thereon, a plot diagram depicting vaporization behavior of heat-set mineral oils as a function of web velocity.

The embodiments of the invention have been described hereinbefore in relation to the "production run" mode wherein the expulsion of solvent vapors in the dryer depends upon the web velocity (note FIG. 2). With increasing web velocity, the expulsion of solvent vapors reaches its maximum towards the end of the dryer. When the machine speed is relatively low, the concentration of solvent vapors in the dryer 6 follows the curve 15, reaching a maximum at the point I. Curves 16 and 17 represent the concentration over the indicated length in the dryer 6 for a relatively moderate and a relatively fast machine speed, respectively, the maxima of the curves 16 and 17 being at points II and III, respectively. As is apparent from the curves 15, 16, 17 and 18, the absolute values of the vapor concentrations at the points I, II, III and IV increase with increasing web velocity. The curve 18 with its maximum at the point IV reflects the values of the solvent concentration at the highest machine speed. In this regard, the maximally permissible concentration in the dryer exhaust gas, i.e., approximately 25% of the lower explosion limit, may be reached. If this concentration of approximately 25% of the lower explosion limit is reached in the dryer exhaust, the control unit 11 intervenes and reduces the machine speed until a sufficient safety margin with respect to the lower explosion limit is attained.

Figure 3:
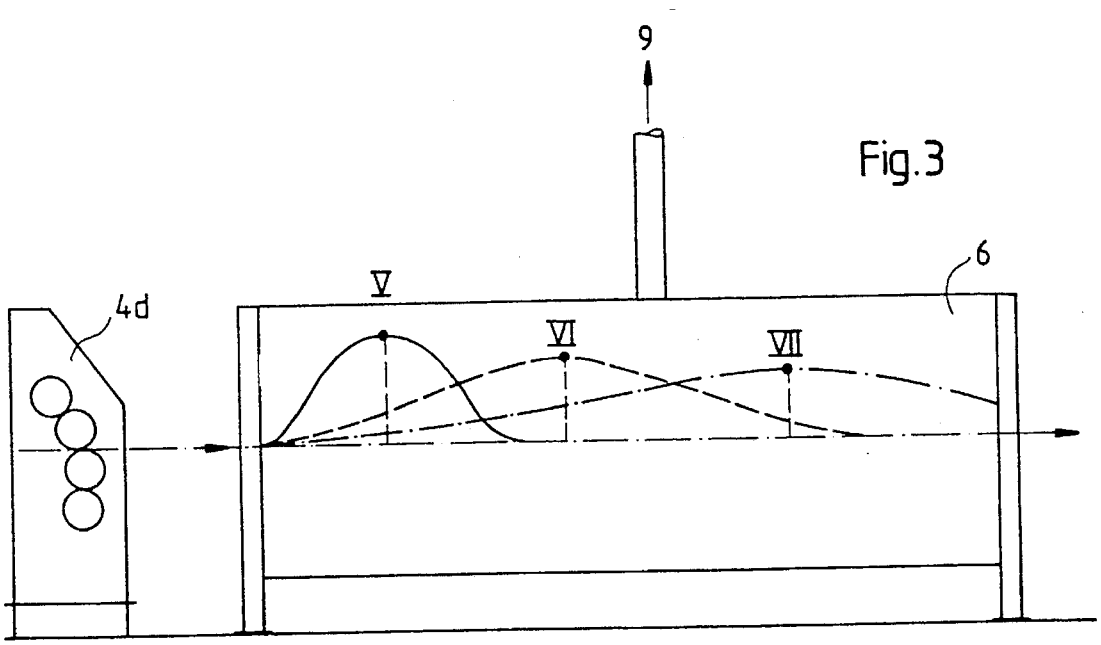
FIG. 3 is a view like that of FIG. 2 showing the dryer superimposed by a plot diagram depicting evaporation behavior of blanket washing agents within the dryer as a function of web velocity.

The relationships are different with respect to the "blanket washing" mode of operation (FIG. 3). The amount of washing fluid conveyed into the dryer by the web traveling therethrough is independent of the machine speed. This means that, for a lower web velocity per unit of time, exactly as much washing-fluid vapors must be expelled as for a higher web velocity per a like unit of time. A consequence thereof, in turn, is that the permissible lower explosion limit for the "blanket washing" mode, is reached even earlier at very low velocities, particularly in the first half of the dryer.

For a constant quantity of washing fluid and a very high web velocity, a relatively little amount of washing-fluid vapors may be expelled per unit of time in the first half of the dryer, the risk of reaching the lower explosion limit being less than for a very low web velocity.

In FIG. 3, the characteristic curves for the concentrations of the washing-fluid vapors present in the dryer exhaust gas are shown plotted over the length of the dryer. The curve V represented by a solid line has a critical maximum at the point V. For a relatively low web velocity, a given amount of washing fluid is vaporized in the first half of the dryer, the vapor concentration rising quite rapidly to the maximum V.

If the web velocity is increased, such as to the higher web velocity in the "blanket washing" mode, the respective maxima of the washing-fluid concentrations decrease (note FIG. 3, maximum points VI and VII of the broken-line curve and the dash-dot or phantom-line curve, respectively). On the one hand, at a higher washing velocity, e.g. higher web velocity, the washing fluid is applied to a longer web-length section, so that the concentration level is lower. In addition, at higher blanket washing velocities, the time intervals for the expulsion of washing-fluid or solvent vapors in the dryer are briefer. Therefore, when approximately 25% of the lower explosion limit has been reached, the rotary printing machine 1 is accelerated in order to lower the concentration maximum V of the solvent or washing fluid. For this reason, the control unit 11 has another function in the "blanket washing" mode.

If the evaluation electronic system of the control unit 11 detects the maximally permissible solvent concentration, the main drive 5 receives a signal preventing a reduction in velocity. If, in the "blanket washing" mode, the detected solvent-concentration value exceeds the maximally permissible value, the control unit 11 increases the machine speed by transmitting appropriate signals to the main drive 5. Simultaneously, the control unit 11 may also discontinue or shut off the injection of washing fluid in order to reduce drastically the quantity of vaporizing washing fluid which has entered the dryer 6.

The control unit 11 may also be used to prevent a by-pass from being opened, and thereby prevent the expulsion to the surroundings of vapors which are detrimental to the environment, when the combustion system 9 reaches the maximally permissible temperature. It is possible also to monitor the maintenance of the maximally permissible operating temperature of the combustion system 9, in addition to detecting the increase-in-temperature behavior within the combustion system 9. If the combustion system is overheated, the rotary printing machine 1 may be shut down or the machine speed may be reduced drastically.

Figure 4:
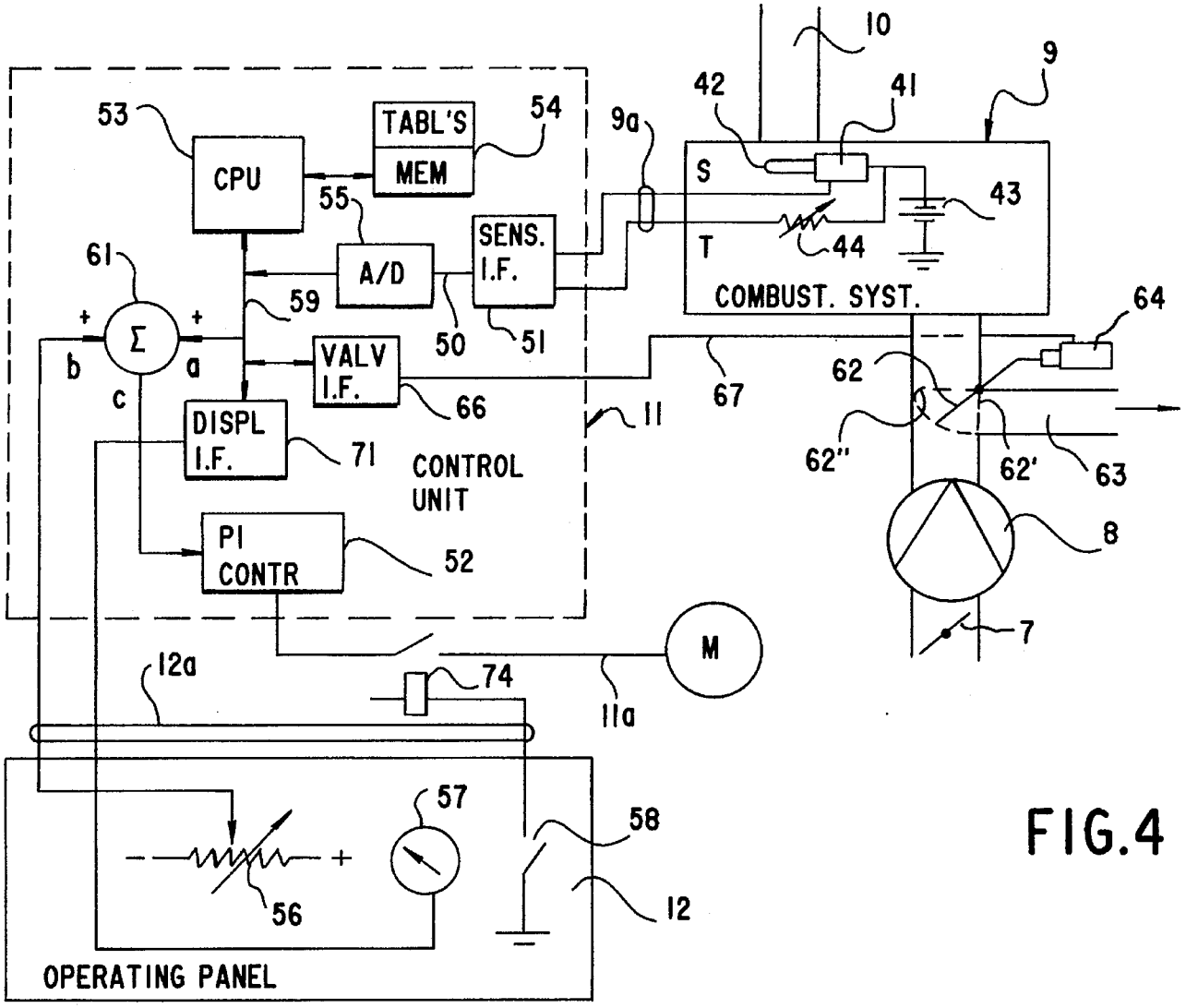
FIG. 4 is a block diagram of the control sections of the printing machine.

FIG. 4 shows, in block diagram form, details of the control system of the invention contained in the combustion system 9 and in the control unit 11 connected via the motor control lead 11*a* to the machine drive 5, namely a motor M thereof.

Thus, provided in the combustion system 9 are a solvent concentration detector 41 of conventional construction, e.g., of the type having a platinum wire sensor 42 in the exhaust outlet 10, and a temperature sensor 44, e.g., in the form of a thermistor, a thermo-couple or the like. A power source 43 supplies electric current for the solvent concentration sensor 41 and the thermistor 44.

The solvent concentration sensor 42 and the temperature sensor 44 are are connected via respective connections S and T, which form the control line 9*a*, to a sensor interface 51 in the control unit 11. The control unit 11 contains a motor control arrangement for the drive motor M. The sensor interface 51 receives analog inputs at the connections S and T and provides a combined multiplexed output 50 connected to an analog-to-digital converter 55. The A/D converter 55 presents digital outputs representing temperature and solvent concentration to a common data bus 59 of a computer composed of a control processing unit or CPU 53 connected to a memory 54. The memory 54 contains stored tabular data representing the optimal relationship between the solvent concentration and the temperature in the combustion system or chamber 9 and the speed of the motor M which drives the paper web. The CPU 53 is connected via the bus 59 to a summing circuit 61 having a summing input a representing the computed optimal motor speed determined from speed tables in the memory 54 based upon readings of solvent concentration and temperature in the combustion system 9, as determined by the temperature sensor 44 and the solvent concentration detector 41. The summing circuit 61 receives a further input b from a manual controller 56 in the operating panel 12. By means of the controller 56, the pressman or other operator can manually modify or override a motor control signal appearing at an output c of the summing circuit 61.

The output signal at the output c of the summing circuit 61 is connected to an input of a proportional-integral (PI) motor controller 52 which controls the speed of the drive motor M coupled to the main drive 5. The operating panel 12 also includes a display 57 which is connected via a display interface 71 to the CPU 53 and operates to display the temperature in the combustion system 9 and/or the solvent concentration. A manual switch 58 is connected to a motor control relay 74 and enables the pressman or other personnel to turn the drive power for the motor M on or off.

It follows that further control variables may be applied to the system. For example, as described hereinbefore, based upon the inputs from the detector 41 and the sensor 44, the CPU 53 computes the temperature gradient, and the thus computed gradient may be displayed on the display 57. Depending upon the detected and measured temperature values and the gradients thereof, the CPU 53 may calculate the amount of solvent transformed or consumed in the combustion system 9.

Based upon the control programs stored in the memory 54 and the tables stored in the table section of the memory 54, the computer or CPU 53 may additionally be arranged to determine the maximally permissible amount of solvent during a production run and during a washing mode operation of the printing machine. It follows that the control system 11 can be arranged to determine changes and rates of changes, i.e., gradients, of the temperature in the combustion system 9, as described hereinbefore, and accordingly control the speed of the motor M so as to maintain it at such a level that the temperature remains within safe limits.

An exhaust arrangement may be provided wherein the exhaust gas can be diverted by the blower 8 to the exterior surroundings, in case the temperature exceeds a maximum permissible value. Such an arrangement is shown in FIG. 4 as including an exterior exhaust gas outlet 63 branching from the blower 8 and having a two-way flap valve 62 driven by a valve solenoid 64 which, in turn, is controlled via a line 67 by a valve control interface 66 connected to the computer bus 59.

During normal operation, the valve flap 62 is in the vertical position thereof represented by the broken line 62', wherein the exterior blower outlet 63 is shut off. In case of excessive temperature, the valve flap 62 is transferred into the horizontal position thereof illustrated in FIG. 4 by the broken line 62" due to the action of the solenoid 64 controlled by the computer or CPU 53 via the valve interface 66, thereby preventing further inflow of solvent to the combustion system 9.

Figure 5:
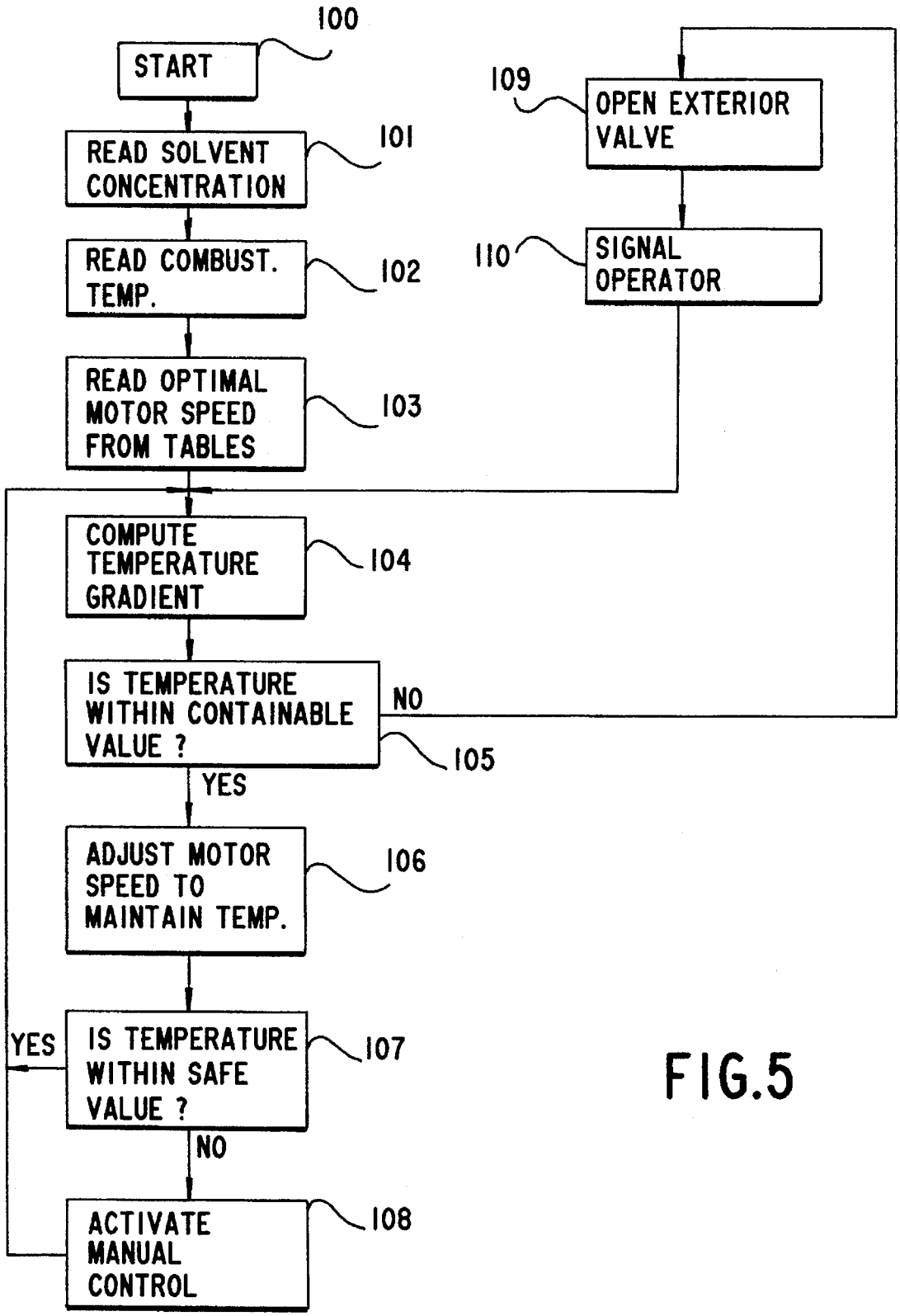
FIG. 5 is a flow chart showing the steps of the operation of the invention.

FIG. 5 is a flow chart showing the operation of the control system according to the invention. After starting at 100, the solvent concentration and the temperature in the combustion system are read in respective steps 101 and 102. Next, the optimal motor speed is determined in step 103 from tables in the memory 54, and the temperature gradient is computed in step 104. In step 105, a determination is made as to whether or not the temperature appears to be within a containable value. If the determination is negative, the valve 62 is switched into the position 62" thereof, opening the exhaust to the exterior as indicated at 109, and a signal is given to the pressman or other operator in step 110 that human intervention is required. The temperature gradient is then determined again at 104. If the temperature appears to be within a containable value, as determined in step 105, the motor speed is adjusted in step 106 to a proper value, e.g., as defined by the tables or from experience values. Then, the combustion temperature is measured again in step 107 to determine if it is within a safe value. If affirmative, the control loops back to step 104 and the control proceeds as hereinbefore, but if the response is negative, manual control is activated in step 108, leaving further decisions to the pressman or other personnel.

I claim:

1. Method of controlling a rotary printing machine having a thermal dryer to which a combustion system is post-connected, which comprises determining changes in temperature of exhaust gas in the combustion system and, in accordance therewith, varying the speed of operation of the rotary printing machine.

2. Method according to claim 1, which includes continuously measuring the temperature of the exhaust gas, continuously detecting the measured temperature values, and calculating therefrom an amount of solvent transformed in the combustion system from a vapor thereof formed in the thermal dryer from a solvent-bearing web passing therethrough.

3. Method according to claim 2, wherein said printing machine is operable in a production run for producing prints and in a washing mode for washing machine components with solvent, the method which includes comparing the calculated amount of transformed solvent with a maximally permissible solvent amount both in a production run and in a washing mode of operation of the rotary printing machine.

4. Device for controlling a rotary printing machine having a thermal dryer and a combustion system post-connected to the thermal dryer, comprising means for determining changes in temperature of exhaust gas in the combustion system, and means for varying speed of operation of the rotary printing machine in accordance with temperature changes determined by said determining means.

5. Device according to claim 4, including continuously detecting means for continuously detecting measured temperature values of the exhaust gas in the combustion system, and calculating means for calculating therefrom a calculated amount of transformed solvent in the combustion system from a vapor thereof formed in the thermal dryer from a solvent-bearing web passing therethrough.

6. Device according to claim 5, including comparing means for comparing the calculated amount of transformed solvent with a maximally permissible solvent amount.

7. Device according to claim 5, wherein the rotary printing machine has a main drive, and including a control unit comprising said calculating means connected between and to the main drive and the combustion system, and means for continuously transmitting from said continuously detecting means continuously detected measured temperature values to said control unit.

8. Device according to claim 7, including a control line connecting locations at which said measured temperature values are measured in the combustion system to said control unit.

9. Device according to claim 7, wherein said control unit includes electronic control means.

10. Device according to claim 7, including an operating panel, and an operating line connecting said operating panel to said control unit for adjusting said control unit.

11. Device according to claim 7, including means for comparing the calculated amount of transformed solvent with a maximally permissible solvent amount, and said control unit having means for varying the speed of said main drive in accordance with a comparison result of said comparing means.

12. Device according to claim 7, including means for shutting the combustion system down, and means for by-passing the combustion system and discharging the solvent vapors into the surroundings, said control unit including means operative for the operating speed of the rotary printing machine in accordance with the maximum permissible temperature of the combustion system and for thereby preventing activation of said shutdown means and said by-pass means.

* * * * *